United States Patent [19]

Lenger

[11] Patent Number: 4,709,641

[45] Date of Patent: Dec. 1, 1987

[54] ADJUSTABLE TABLE STRUCTURE

[75] Inventor: Sidney A. Lenger, Kernersville, N.C.

[73] Assignee: The Pilliod Cabinet Company, Swanton, Ohio

[21] Appl. No.: 897,504

[22] Filed: Aug. 18, 1986

[51] Int. Cl.[4] ..... A47B 11/00

[52] U.S. Cl. ..... 108/102; 108/143

[58] Field of Search ..... 108/102, 90, 93, 78, 108/143, 137, 103

[56] References Cited

U.S. PATENT DOCUMENTS

| | | | |
|---|---|---|---|
| 831,797 | 9/1906 | Miller | 108/93 |
| 1,300,533 | 4/1919 | Wessinger | 108/93 X |
| 1,911,854 | 5/1933 | Somma | 108/102 X |
| 2,227,786 | 1/1941 | La Fee | 108/93 X |
| 2,251,737 | 8/1941 | Johnson | 108/102 |
| 2,293,496 | 8/1942 | Egger | 108/93 |
| 2,315,922 | 9/1919 | Franklin | 108/143 |
| 2,891,679 | 6/1959 | Maupin | 108/93 |
| 3,044,197 | 7/1962 | Cook | 108/93 X |
| 4,117,627 | 10/1978 | Slingerland, Jr. | 108/103 X |
| 4,500,146 | 2/1985 | Peterson | 108/102 X |
| 4,552,033 | 11/1985 | Märzhäuser | 108/143 X |

FOREIGN PATENT DOCUMENTS

| | | | |
|---|---|---|---|
| 244534 | 5/1965 | Austria | 108/137 |
| 481626 | 8/1929 | Fed. Rep. of Germany | 108/93 |
| 2107718 | 9/1972 | Fed. Rep. of Germany | 108/103 |
| 1,396,421 | 3/1965 | France | 108/102 |
| 2462124 | 3/1981 | France | 108/102 |
| 4740 | of 1911 | United Kingdom | 108/137 |

*Primary Examiner*—Kenneth J. Dorner
*Assistant Examiner*—José V. Chen
*Attorney, Agent, or Firm*—Marshall & Melhorn

[57] ABSTRACT

A table comprises a floor engaging base section including a top structural member having an upwardly facing horizontally disposed surface and a downwardly facing horizontally disposed surface. The structural member is in spaced relation above the supporting floor and has a slot formed therein. A top member has an upwardly facing horizontally disposed supporting surface and a second downwardly facing surface disposed in facing relation to the upwardly facing surface of the top structural member of the base section. Guide means extend downwardly from the top member through the slot formed in the top structural member of the base section for attaching the top member to the base section to permit movement of the top member relative to the base section along the path defined by the slot.

1 Claim, 5 Drawing Figures

ADJUSTABLE TABLE STRUCTURE

BACKGROUND OF THE INVENTION

With the advent of the development and consumer acceptance of reclining chair and seat structures, it has become necessary to develop a compatible table structure. Typically, known table structures are somewhat static in function. Such tables are either stationary, or may be extended. The extensible type table structure permits the supporting surfaces to be enlarged in directions normal to or longitudinally of the longitudinal horizontal axis.

The most current reclining chair mechanisms permit almost universal selective adjustment from a fully upright seated position to a fully reclined position. Adjustment of the reclining chair is a function of many variables such as the height or girth of the user; the particular use to which the user wishes to put the reclining chair, such as snoozing, television viewing, music listening, educational radio or television classes requiring notes to be taken, etc.; and the requirement, whether perceived or real, to rapidly vary the chain inclination. Each of these various factors may necessarily require an ancillary supporting table surface capable of assuming different and distinct positions relative to the user.

It is an objective of the present invention to provide a table have a supporting surface which may be moved relative to the base portion to assume an infinite number of positions.

Another objective of the invention is to produce a table having a horizontally disposed supporting surface which may be readily varied to assume various positions thereof.

Still another objective of the invention is to produce a table structure having a horizontally disposed supporting surface which may be readily moved to a infinite number of positions in the same horizontal plane.

SUMMARY OF THE INVENTION

The above, as well as other objectives and advantages of the invention, are typically achieved by a table comprising a floor enaging base section including a horizontally disposed surface in spaced relation above a supporting floor and having a slot formed therein; a top member having an member 32 in spaced relationship thereto. The top 32 includes a planar supporting surface 33 and is secured to the base portion 12 for relative movement by means of a mounting device, generally designated 34. The mounting device 34 includes a fastener 36 and a mounting plate 38. As best shown in FIG. 3, the top member 32 and mounting plate 38 are positioned, respectively, above and below the structural member 14 and include apertures 40 and 42, respectively, aligned with a longitudinal slot 44 provided in the top structural member 14. The fastener 36 includes an elongate, threaded shank portion 46 depending from an enlarged head portion 48 and is inserted through the aligned openings 40, 42, and 44. The fastener 36 is secured in place by a lock nut 50. As shown most clearly in FIG. 3, the slot 44 is slightly larger than the diameter of the shank 46 to permit free longitudinal movement of the shank portion 46 therein and thus, free longitudinal movement, as indicated by arrow A, of the top member 32 with respect to the top structural member 14 and base portion 12.

The head portion 48 of the fastener 36 may be in the form of a collar to be used as a receptacle for supporting the pole of a lamp 52, for example. To provide adequate support for the lamp 52, and preclude the canting thereof, the mounting plate 38 is of sufficient size, as shown in FIG. 4. The mounting plate 38 will assist in evenly distributing the canting forces over a substantial area. The top surface of plate 38 is provided with a pair of projecting elongate ribs 54 which cooperate with a track member 56 in the bottom surface of the plate 14 to control transitional movement of the plate 38. The ribs 54 and track members 56 are preferably of a lubricious material, such as nylon, for example to reduce friction between the mating parts and provide smooth, free movement therebetween. In like manner, it is preferred that the previously mentioned bearing elements 30 on the top surface of the structural member 14 be of a similar material to provide smooth movement of the planar top member 32 over the structural member 14.

It is apparent from the foregoing description that the invention provides a means for enabling the top member 32 to be moved in a to and fro motion relative to the base portion 18, but also capable of infinite rotational movement in a horizontal plane relative to the base portion 12, about the axis of the shank 46 in the direction of arrow B (FIG. 2). Thus, there is provided a novel table structure 10 with a top supporting surface 33 that may upwardly facing, horizontally disposed, supporting surface and a second downwardly facing surface disposed in facing relation to the horizontal surface of the base section; and means attached to the top member and extending downwardly through the slot formed in the horizontallly disposed surface of the base section for attaching the top member to the base section to permit planar movement of the top member along a path defined by the slot.

BRIEF DESCRIPTION OF THE DRAWINGS

The objectives and advantages of the invention will become clearly manifest to those skilled in the art from reading the following detailed description of a preferred embodiment of the invention when considered in the light of the accompanying drawings, in which.

DESCRIPTION OF THE PREFERRED EMBODIMENT

Figure 1:
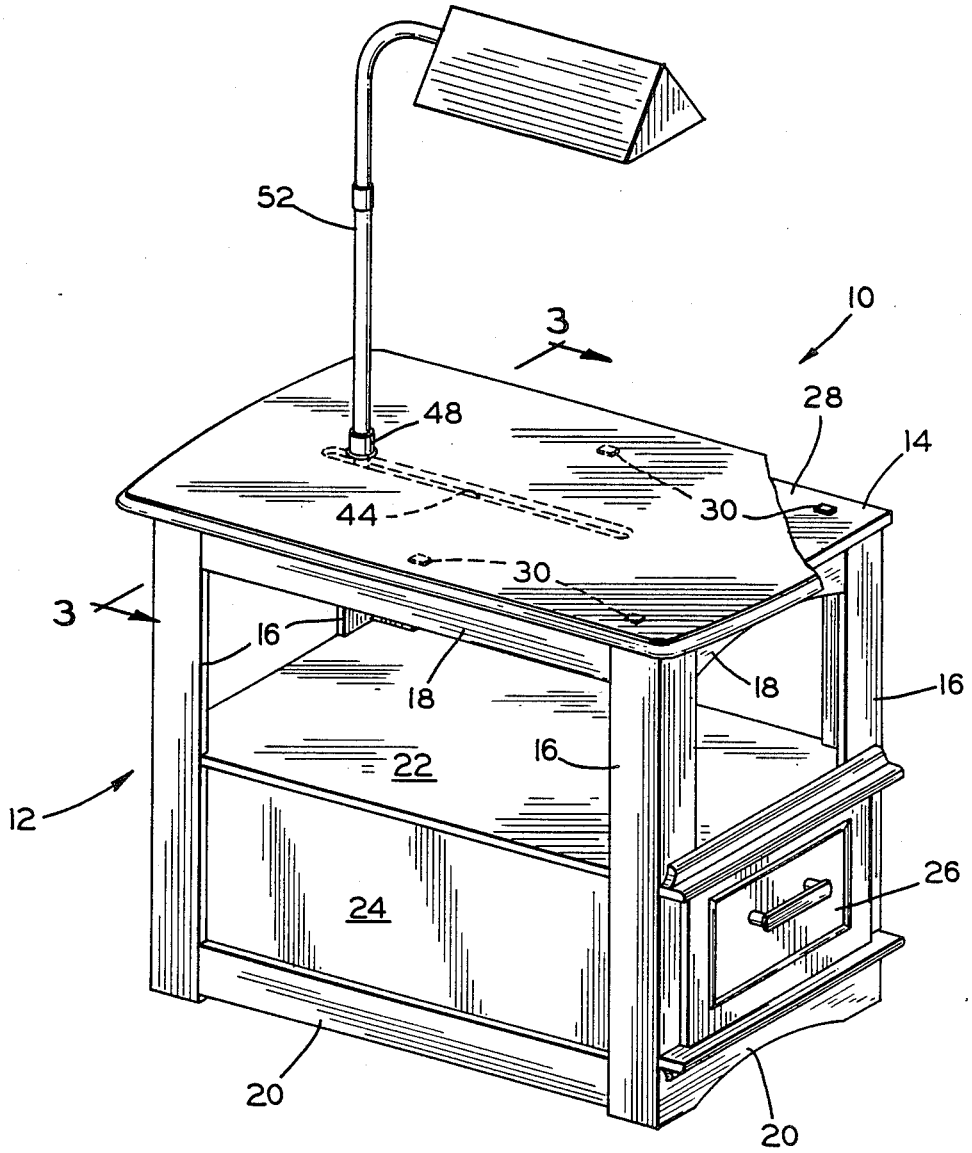
FIG. 1 is a perspective view of a table structure embodying the features of the present invention.
Figure 2:
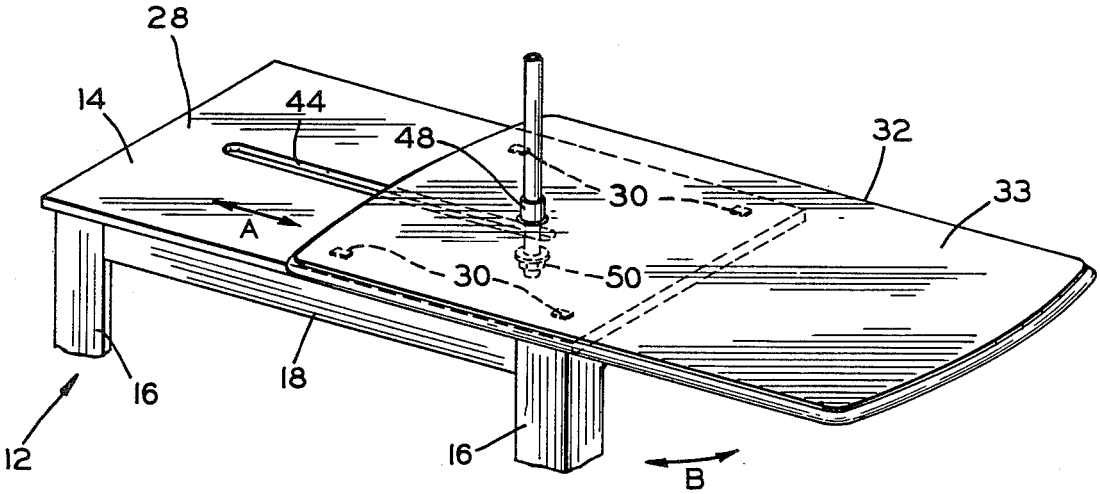
FIG. 2 is a fragmentary perspective view of the table illustrated in FIG. 1 showing the upper supporting surface in a forward position.
Figure 3:
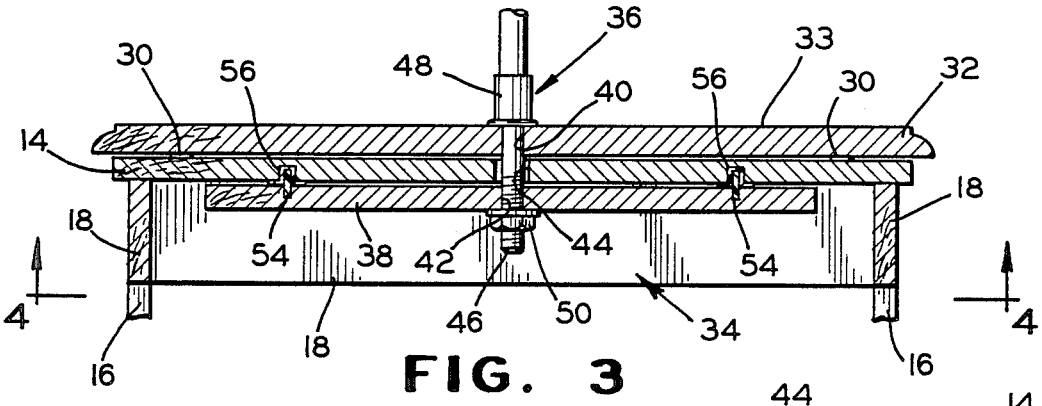
FIG. 3 is a sectional view taken along line 3—3 of FIG. 1.
Figure 5:
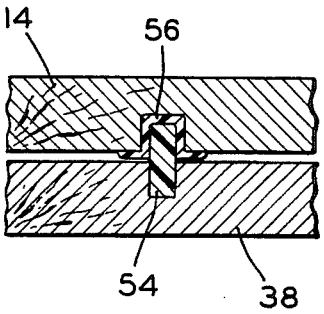
FIG. 5 is an enlarged fragmentary view partially in section of the slide mechanism of the invention.
Figure 4:
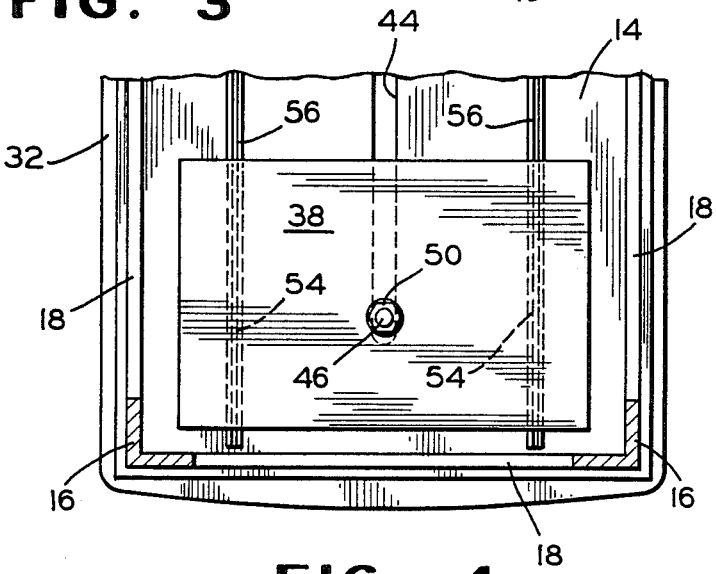
FIG. 4 is a sectional view taken along line 4—4 of FIG. 3.

Referring to FIG. 1 of the drawings, there is illustrated an adjustable table structure generally indicated at 10, constructed in accordance with the present invention. As best shown in FIGS. 1 to 3, the table 10 includes a base portion 12 including a planar horizontal top structural member 14 securely fastened by suitable means to legs 16 and upper cross member 18. The legs 16 are joined together at their lowermost ends by cross members 20 (only two of which are shown). Although not limited thereto, the table may include a shelf 22 as shown in FIG. 1. The space between the shelf 22 and cross members 20 may also be enclosed by three side walls 24, (only one of which is shown) and a front access door 26 which cooperate to form a storage compartment.

The upper surface 28 of the structural member 14 has affixed thereto, four bearing elements or slides 30 for slidably supporting a movable top be readily oriented in an infinite number of positions to satisfy the needs of the user.

Although the invention has been described with the top surface 33 supporting a lamp, it is well within the purview of the present invention that the supporting surface may be made free of any such obstructions. To this end, the head 48 to the fastener 36 can be omitted and the shank portion 46 directly attached to the underside of the top member 32 by an suitable means. One such means for attaching would be to substitute the through hole 40 with a blind hole (not shown) for receiving the upper end of the shank 46 by threading or friction fit. Thus, there would be provided an upper supporting surface that is totally free of any fixed obstructions.

Also, it will be understood that the table top 33 may be constructed to rotate independently or integral with the shank 46. However, in each instance, the top 33 will be guided in to and fro movement by the slot 44.

While the invention has been described in conjunction with a specific embodiment thereof, it is evident that many alternative modifications and variations will be apparent to those skilled in the art in the light of the foregoing description. Accordingly, it is intended to embrace all such alternatives as fall within the spirit and broad scope of the appended claims.

I claim:

1. A table comprising:

a floor engaging base section, said section including a top structural member having an upwardly facing horizontally disposed surface and a downwardly facing horizontally disposed surface, the structural member in spaced relation above the supporting floor and having a slot formed therein;

a top member having an upwardly facing horizontally disposed supporting surface and a second downwardly facing surface disposed in facing relation to the upwardly facing surface of the top structural member of said base section;

guide means extending downwardly from said top member through the slot formed in the top structural member of said base section for attaching said top member to said base section and permitting movement of said top member relative to said base section along a path defined by the slot and including a mounting plate slidingly coupled to the downwardly facing surface of the top structural member of said base section for movement with said top member; and track means positioned between the mounting plate of said guide means and the top structural member of said base section to slidingly guide relative movement between the mounting plate and the top structural member.

* * * * *